United States Patent [19]

Feddersohn et al.

[11] 4,165,090

[45] Aug. 21, 1979

[54] CURB SLIDER DEVICE FOR SKATEBOARDS

[76] Inventors: Richard C. Feddersohn, 249 Vista Del Monte, Anaheim, Calif. 92807; William S. Schaffer, 1252 Richard Ave., Orange, Calif. 92669

[21] Appl. No.: 874,036

[22] Filed: Jan. 31, 1978

[51] Int. Cl.[2] ..... A63C 17/00

[52] U.S. Cl. ..... 280/87.04 A

[58] Field of Search ..... 280/87.04 A, 87.04 R, 280/87.01, 8, 5.24, 11.28, 11.27, 11.16, 11.1; 16/18 CG

[56] References Cited

U.S. PATENT DOCUMENTS

| | | | |
|---|---|---|---|
| 809,913 | 1/1906 | Ferris | 280/87.01 |
| 885,977 | 4/1908 | Brown | 280/87.01 |
| 3,951,422 | 4/1976 | Hornsby | 280/11.28 |
| 3,992,025 | 11/1976 | Amelio | 280/87.04 A |

FOREIGN PATENT DOCUMENTS

| | | | |
|---|---|---|---|
| 959743 | 4/1950 | France | 280/11.1 |

*Primary Examiner*—John A. Pekar

[57] ABSTRACT

A skateboard with front and rear slider devices located inside the wheel trucks. The devices form an angle not less than 15° nor more than 45° with the skateboard. One end of each device is attached to the skateboard, the other end is attached to the wheel truck.

3 Claims, 5 Drawing Figures

CURB SLIDER DEVICE FOR SKATEBOARDS

BACKGROUND OF THE INVENTION

1. Field of the Invention

This invention relates to skateboards and more particularly to slider devices which enable the skateboard user to negotiate curbs and dips.

2. Description of the Prior Art

All conventional skateboards include two wheels mounted on a truck which is attached to the underside forward portion of the board and two wheels mounted on a truck that is attached to the underside rear portion of the board.

In using skateboards curbs and dips present a problem since when one set of wheels has passed over a curb the underside of the board and the truck comes in contact with the curb edge slowing down the board and throwing the rider forward off the board.

In other situations, a rider may, by proper manuevers and balance, direct the front wheels of the board over a curb or obstruction but the rear truck and wheels then catch, stopping the board, tearing the wheels off or damaging the wheels and truck and throwing the rider off the board.

U.S. Pat. No. 3,235,282 seeks to avoid these problems by the use of movable wheels.

U.S. Pat. No. 3,023,022 has outrigger wheels which would assist a childs scooter to negotiate curbs and unbalancing obstacles.

Neither of these approaches satisfactorily solves the problems associated with the use of skateboards in areas where curbs, dips or obstructions are present.

OBJECTS AND ADVANTAGES OF THE INVENTION

It is therefore an object of this invention to provide a slider device which enables a person to negotiate a curb or dip while riding a skateboard.

Another object of this invention is to increase the stability of the front and rear wheel trucks.

Still another object of this invention is to improve the safety of skateboards by reducing hang-ups and falls.

Another object of this invention will be to increase the mobility of skateboards since the slider will act as a third wheel for both the front and rear wheel truck.

A further object of this invention is to improve the turning ability of the skateboard.

A still further object of this invention is to increase the strength of the skateboard by the torsion bar action of the slider.

Yet another object of this invention is to protect the wheel trucks from damage.

These and other objects will be apparent from the specifications and claims.

DESCRIPTION OF THE PREFERRED EMBODIMENT

Figure 1:
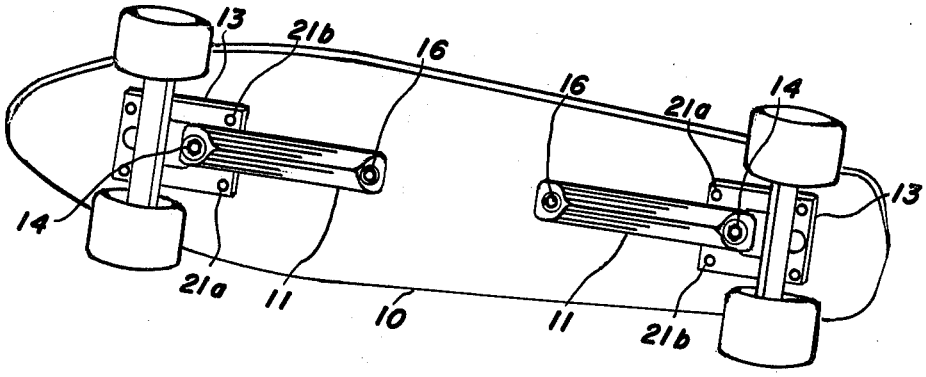
FIG. 1 is a perspective bottom view of a skateboard equipped with the sliders of this invention.
Figure 2:
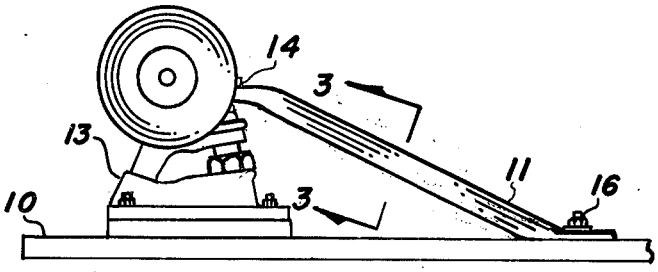
FIG. 2 is a fragmentary side view of the preferred mode showing the slider attached to the top of the wheel truck and the skateboard.
Figure 3:
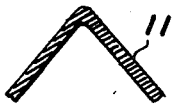
FIG. 3 is a cross-section through 3—3 of FIG. 2.

Referring now to the drawings, there is shown in FIG. 1, a skateboard 10 containing the structure of the present invention. One end of the slider 11 is attached to the top of the skate truck 13 by means of a fastener 14 which passes through a hole in one end of the slider. The other end is attached to the skateboard 10 by one or more fasteners 16 which passes through one or more holes in the other end of the slider. The angle of the slider can be no less than 15° nor more than 45° in order to guide the board over high points and curbs and prevent hang-ups. The slider should be shaped to offer minimum resistance to sliding as shown in FIG. 3.

Figure 5:
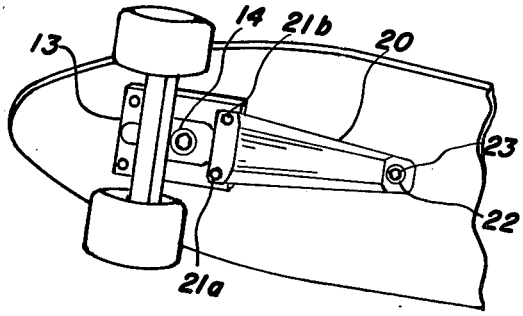
FIG. 5 is a top view of the alternate mode of FIG. 4.
Figure 4:
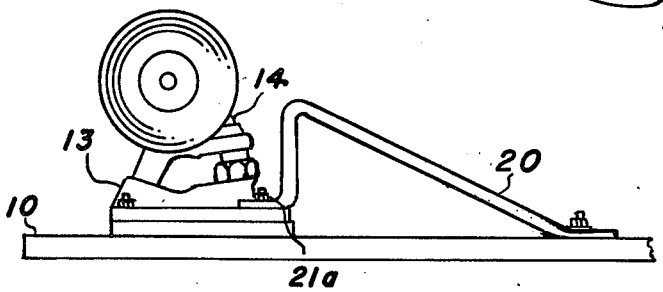
FIG. 4 is a fragmentary side view of an alternate mode showing the slider attached to the bottom of the wheel truck.

An alternate form of the invention is shown in FIG. 4–5. In this mode, the slider 20 is attached to the truck by utilizing the same fastener means 21*a* and 21*b* as it holds the truck 13 to the board 10.

The slider 20 is shaped to receive a washer means 22 and a fastener means 23 at the other end and attached thereby to the skateboard 10.

By means of the above construction, one utilizing skateboards equipped with this invention can improve his performance and avoid injuries by safely negotiating curbs and dips.

We claim:

1. For use in a skateboard device with two truck means, two slider means, attachment means at each end of the slider means, one end attachment means of each slider means connected with a portion of a truck means located furthest from the skateboard, at least one predrilled hole means central to the width through the skateboard located to interconnect with the other end of each slider means so as to form an angle of not less than 15° or greater than 45° between the skateboard and the slider means.

2. Slider means as described in claim 1, in which the cross-section of the body of said slider means is shaped at an angle of 90°, the apex of the right angle extends outward to engage the curb, each end of which is flattened to receive fastener means.

3. Two slider means for use on a skateboard device having two truck means, each slider means comprising, a U-shaped metal rod the apex of the U-shaped sized to receive a fastener means for attachment to the mid-point of the skateboard; each leg of the U extends upward at an angle no less than fifteen degrees nor more than forty five degrees toward a separate wheel at a point just below the skating surface of the wheel and directly above the inward fastener means for attaching said wheel truck to the board then shaped downward at an angle which is the complement of the angle formed with the skateboard by the slider, the end of each leg is shaped to an angle and formed to receive fastener means used to attach the wheel truck at that point to the skateboard.

* * * * *